US012285089B1

(12) United States Patent
Young

(10) Patent No.: US 12,285,089 B1
(45) Date of Patent: Apr. 29, 2025

(54) UNIVERSAL RETROFITTABLE MAGNETIC CLOSING DEVICE FOR AN OUTDOOR UMBRELLA

(71) Applicant: David Young, Elgin, IL (US)

(72) Inventor: David Young, Elgin, IL (US)

( * ) Notice: Subject to any disclaimer, the term of this patent is extended or adjusted under 35 U.S.C. 154(b) by 220 days.

(21) Appl. No.: 18/209,430

(22) Filed: Jun. 13, 2023

Related U.S. Application Data

(60) Provisional application No. 63/351,514, filed on Jun. 13, 2022.

(51) Int. Cl.
*A45B 25/08* (2006.01)
*A45B 25/06* (2006.01)

(52) U.S. Cl.
CPC ..... *A45B 25/08* (2013.01); *A45B 25/06* (2013.01)

(58) Field of Classification Search
CPC ..... A45B 25/06; A45B 25/08
See application file for complete search history.

(56) References Cited

U.S. PATENT DOCUMENTS 2,405,044 A * 7/1946 Montalvo ..... A45B 25/12 135/44
3,510,079 A * 5/1970 Flowers ..... D01H 7/16 242/597.6
6,129,101 A * 10/2000 Dubinsky ..... A45B 25/165 135/22
9,414,657 B1 * 8/2016 Cheng ..... A45B 25/12
2004/0060584 A1 * 4/2004 Diggle ..... H04Q 1/025 135/16
2004/0060585 A1 * 4/2004 Brent Rivers ..... A45B 11/00 135/16
2013/0153737 A1 * 6/2013 Zoeteman ..... E04H 12/2238 248/513
2017/0105495 A1 * 4/2017 Harris ..... A45B 19/04
2018/0064219 A1 * 3/2018 Cho ..... A45B 19/00

* cited by examiner

*Primary Examiner* — Noah Chandler Hawk
(74) *Attorney, Agent, or Firm* — Steven Ivy P.C.

(57) ABSTRACT

Disclosed is a magnetic closing device used with outdoor/patio umbrellas. The magnetic closing device is used for automatically closing the umbrella in windy conditions. The magnetic closing device includes two primary components: a magnetic component, or pole clamp collar; and a metallic component, or runner clamp collar. The runner clamp collar is attached to the runner hub of the umbrella, and the pole clamp collar is attachable to the intermediate pole section of the umbrella. The pole clamp collar, incorporates a plurality of magnets, which attract the runner clamp collar. The magnetic closing device keeps the umbrella in an open position as long as the magnetic connection between the magnetic component and the metallic component is maintained. The disruption of the magnetic connection results in closure of the umbrella, thereby protecting the umbrella from damage or complete destruction.

10 Claims, 13 Drawing Sheets

100
UNIVERSAL RETROFITTABLE MAGNETIC
CLOSING DEVICE FOR AN OUTDOOR UMBRELLA

PRIOR ART

VIEW A-A

UNIVERSAL RETROFITTABLE MAGNETIC CLOSING DEVICE FOR AN OUTDOOR UMBRELLA

RELATED PATENT APPLICATION

The present Non-Provisional U.S. Patent application claims priority under 35 U.S.C. § 119 (e) to U.S. Provisional Patent Application No. 63/351,514, tiled UMBRELLA WITH MAGNETS, filed on Jun. 13, 2022, the subject matter of which is incorporated herein by reference.

FIELD OF THE INVENTION

The present invention relates to the general field of furniture, outdoor furniture, patio umbrellas, and associated therewith accessories.

BACKGROUND OF THE INVENTION

The outdoor furniture industry encompasses a wide range of products, including outdoor seating, tables, umbrellas, loungers, hammocks, and other outdoor accessories. The global outdoor furniture market size was valued at $48.40 billion in 2022, and is projected to grow from $50.73 billion in 2023 to $72.80 billion by 2030, exhibiting a compound annual growth rate of 5.30%. The industry involves manufacturers, distributors, retailers, and e-commerce platforms catering to both residential and commercial customers.

Perhaps the most popular component of the outdoor furniture industry is an umbrella. Outdoor umbrellas are commonly used in outdoor spaces such as patios, gardens, decks, and poolside areas. The popularity of outdoor umbrellas can vary depending on various factors, including geographical location, climate, and personal preferences.

The continuing popularity has created a high demand for less expensive and lightweight outdoor umbrellas. This demand also resulted in the increased adoption of plastics and other less durable materials in the production of outdoor umbrellas. The adoption of lightweight materials allowed the manufacturers to create more aesthetically pleasing and bigger umbrellas.

As a result, many of the commercially-available umbrellas are easily damaged in windy conditions. The damage frequently occurs when an open umbrella is pushed and lifted by strong winds, causing the umbrella to become airborne. The airborne umbrella may damage other patio furniture and neighboring property. But the most significant problem is the likelihood of injury to the users of the umbrella and to any bystanders.

The present invention resolves the above-defined problem by incorporating a magnetic closing device, configured to automatically close the umbrella's canopy encountering strong winds. More specifically, the magnetic closing device incorporates magnetic and metallic components, designed to create magnetic connection, which is used to keep the umbrella open. The umbrella remains open as long as the magnetic connection between the magnetic components is maintained. The disruption of the magnetic connection, caused by wind pushing on the canopy, results in closure of the umbrella, and protection from destruction.

BRIEF SUMMARY OF THE INVENTION

The following information is intended to be a brief summary of the invention, and as such, said information shall not be used as the means of limiting the scope of the invention:

The present invention discloses UNIVERSAL RETROFITTABLE MAGNETIC CLOSING DEVICE FOR AN OUTDOOR UMBRELLA ("magnetic closing device") attachable to a patio umbrella. The magnetic closing device may be installed onto the umbrella during the manufacturing process of the umbrella, or it may be attached onto an existing umbrella using simple tools and with minimum effort (i.e. retrofitted attachment). The magnetic closing device comprises of two primary components, namely: (1) a magnetic component (or pole clamp collar), and (2) a metallic component (runner clamp collar). The runner clamp collar is attached to the runner hub of the umbrella via a plurality of mounting screws. The pole clamp collar, attachable to the intermediate pole section of the umbrella, incorporates a plurality of magnets and a plurality of spacer screws. The magnets are attached to the magnet surface of the pole clamp collar via a plurality of magnet screws. The spacer screws are configured for manual adjustment, resulting in regulation, or control, of the effective magnetic attraction between the pole clamp collar and the runner clamp collar. The magnetic closing device keeps the umbrella in an open position as long as the finely-adjusted magnetic connection between the magnetic component and the metallic component is maintained. The magnetic closing device was configured to allow windy conditions, impacting the umbrella canopy, disconnect the magnetic connection, thereby separating the runner clamp collar from the pole clamp collar. The disruption of the magnetic connection results in an automatic closure of the umbrella, thereby protecting the umbrella from damage or complete destruction.

BRIEF DESCRIPTION OF THE DRAWINGS

The components shown in the drawings are not to scale. In the interest of clarity, some of the components might be shown in a generalized form and could be identified utilizing commercial designations. All components, including its essential features, have been assigned reference numbers that are utilized consistently throughout the descriptive process outlined herein.

DESCRIPTIVE KEY

Universal Retrofittable Magnetic Closing Device for an Outdoor Umbrella ("Magnetic Closing Device").

100—magnetic closing device
110—magnetic component
111—pole clamp collar
112—pole clamp collar bore
113—locking surface
114—magnet surface
115—plurality of magnets
116—plurality of magnet mounting holes
117—plurality of magnet mounting screws
118—plurality of threaded holes
119—plurality of spacer screws
120—metallic component
121—runner clamp collar
122—runner clamp collar bore
123—bottom surface
124—top surface
125—plurality of mounting holes
126—plurality of mounting screws
200—umbrella
201—canopy
202—stationary hub
203—ribs
204—intermediate pole section
205—runner hub
206—stretchers
207—support pole section

DETAILED DESCRIPTION OF THE PREFERRED EMBODIMENT

Figure 1:
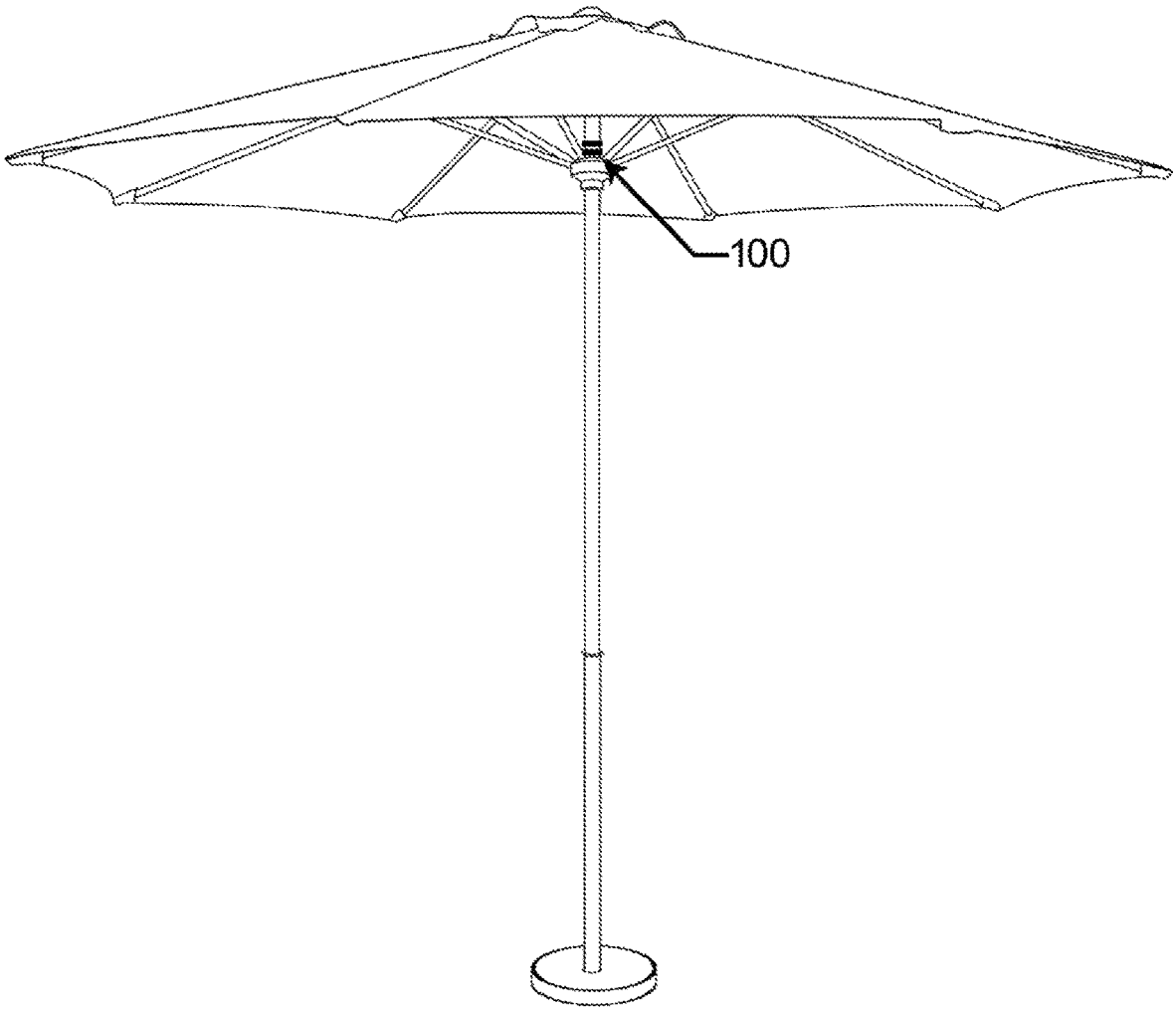
FIG. 1 is a perspective view of a table/patio umbrella incorporating the present invention titled UNIVERSAL RETROFITTABLE MAGNETIC CLOSING DEVICE FOR AN OUTDOOR UMBRELLA ("magnetic closing device"); in accordance with an exemplary embodiment of the present invention.
Figure 2:
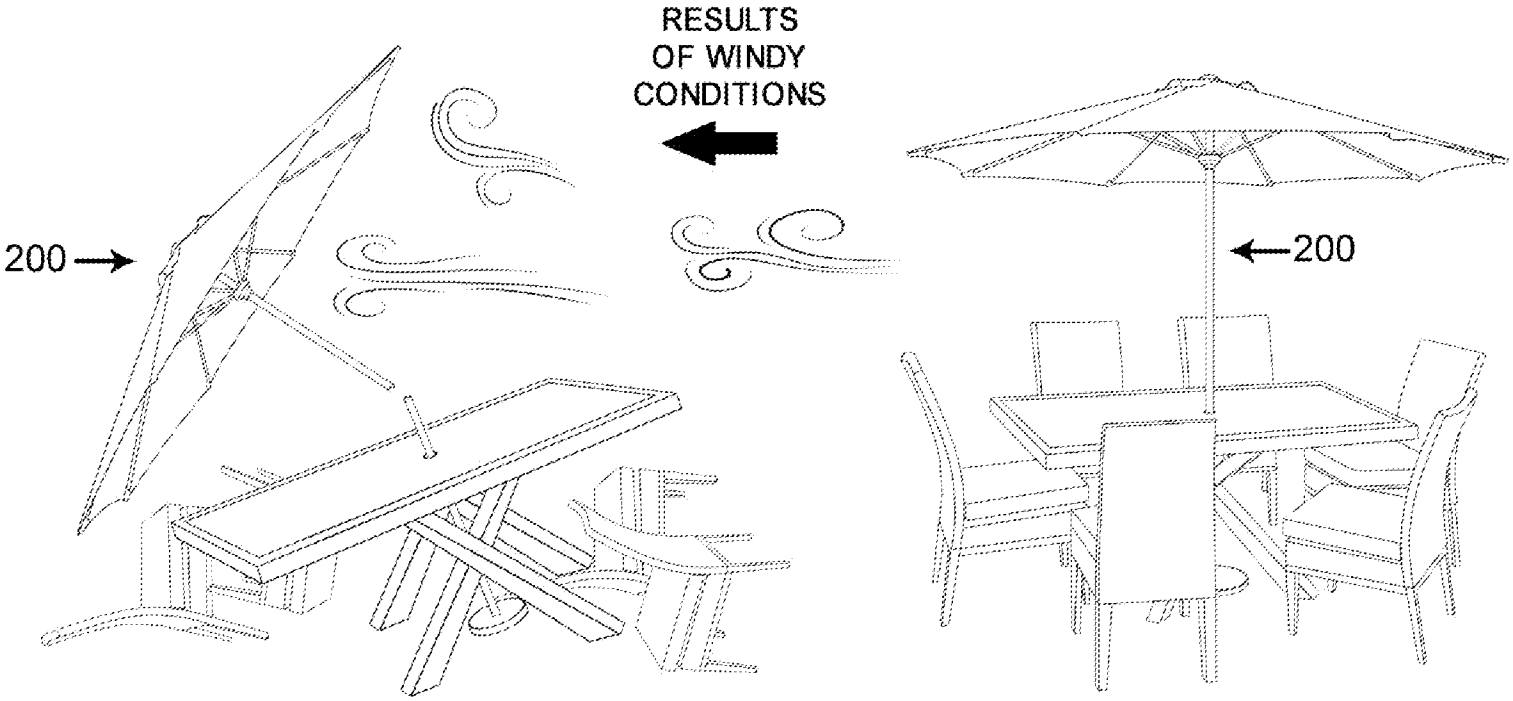
FIG. 2 is an illustration of a pre-existing (prior art) patio furniture arrangement, comprising of a plurality of chairs, a table, and an umbrella, designed to show the potential destruction and disarray caused by an open umbrella in windy conditions, without the use of the present invention; in accordance with an exemplary embodiment of the present invention.
Figure 3:
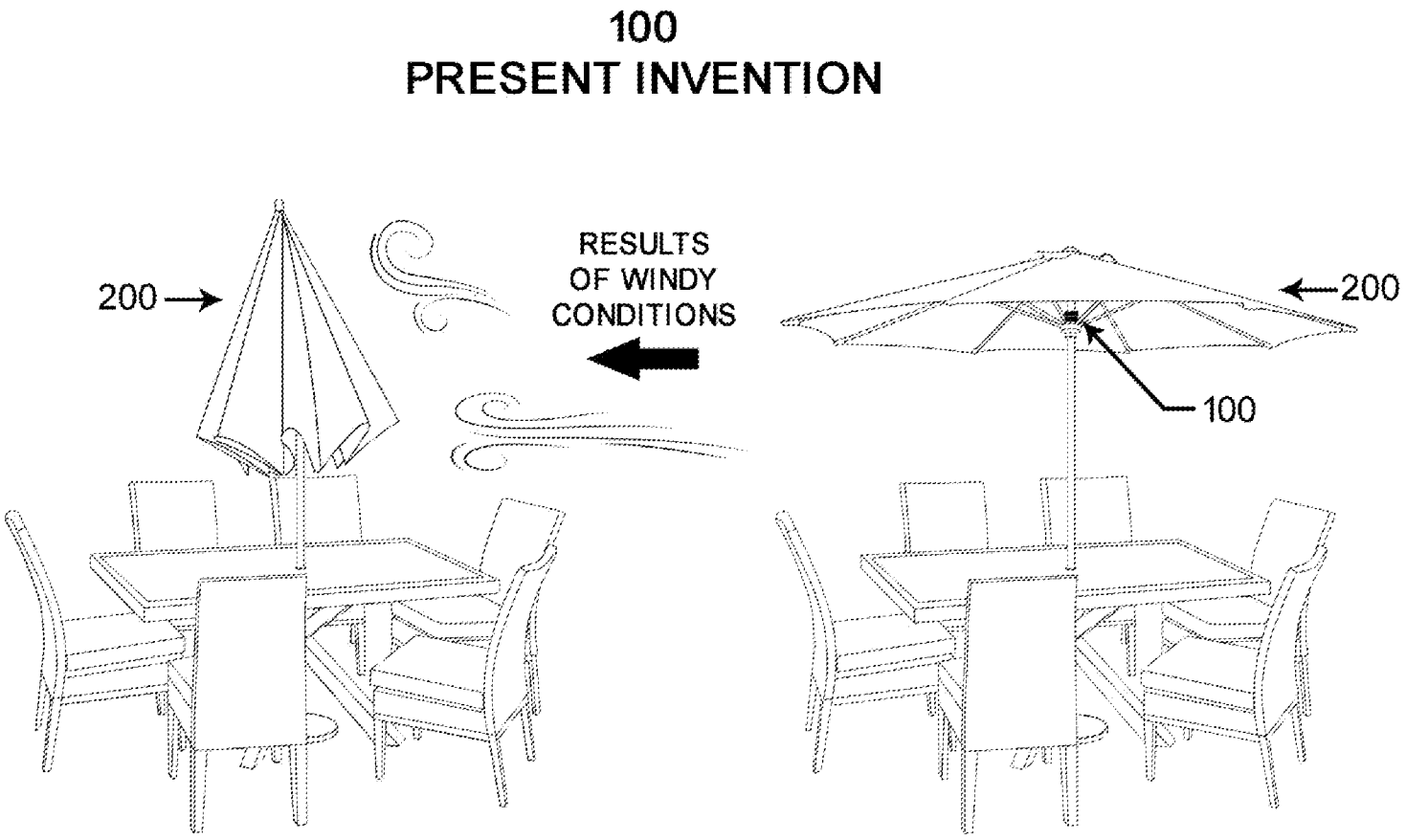
FIG. 3 is an illustration of a pre-existing (prior art) patio furniture arrangement, comprising of a plurality of chairs, a table, and an umbrella incorporating the magnetic closing device, designed to show primary function of the present invention, resulting in automatic closure of the umbrella in windy conditions, thereby preventing destruction of the patio furniture; in accordance with an exemplary embodiment of the present invention.

The following description references to the above-defined drawings and represents only an exemplary embodiment of the invention. It is foreseeable, and recognizable by those skilled in the art, that various modifications and/or substitutions to the invention could be implemented without departing from the scope and the character of the invention:

As shown in FIG. 1, the present invention is a universal, retrofittable, magnetic closing device for an outdoor umbrella ("magnetic closing device") 100. The magnetic closing device 100 is attachable to new and to pre-existing outdoor umbrellas 200. As shown in FIGS. 2 and 3, the magnetic closing device 100 is used for automatically closing the umbrella 200 in windy conditions.

The magnetic closing device 100 comprises of two primary components: (1) a magnetic component 110; and (2) a metallic component 120. The magnetic component 110 is producing a magnetic field. The metallic component 120, is made from ferromagnetic metals (i.e. materials attracted to metals, including but not limited to iron, cobalt, nickel), and is configured to attract the magnetic component 120.

Figure 4:
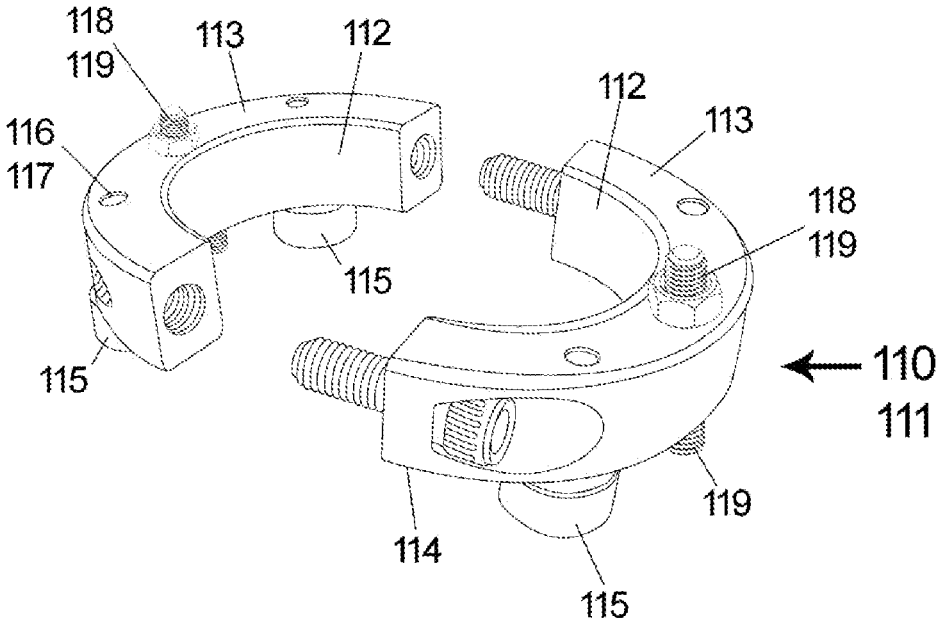
FIG. 4 is a perspective view of a magnetic component, also known as a pole clamp collar, shown in an open position, outlining using the descriptive key the locations of various features and components, including a plurality of magnets and a plurality of spacer screws; in accordance with an exemplary embodiment of the present invention.
Figure 5:
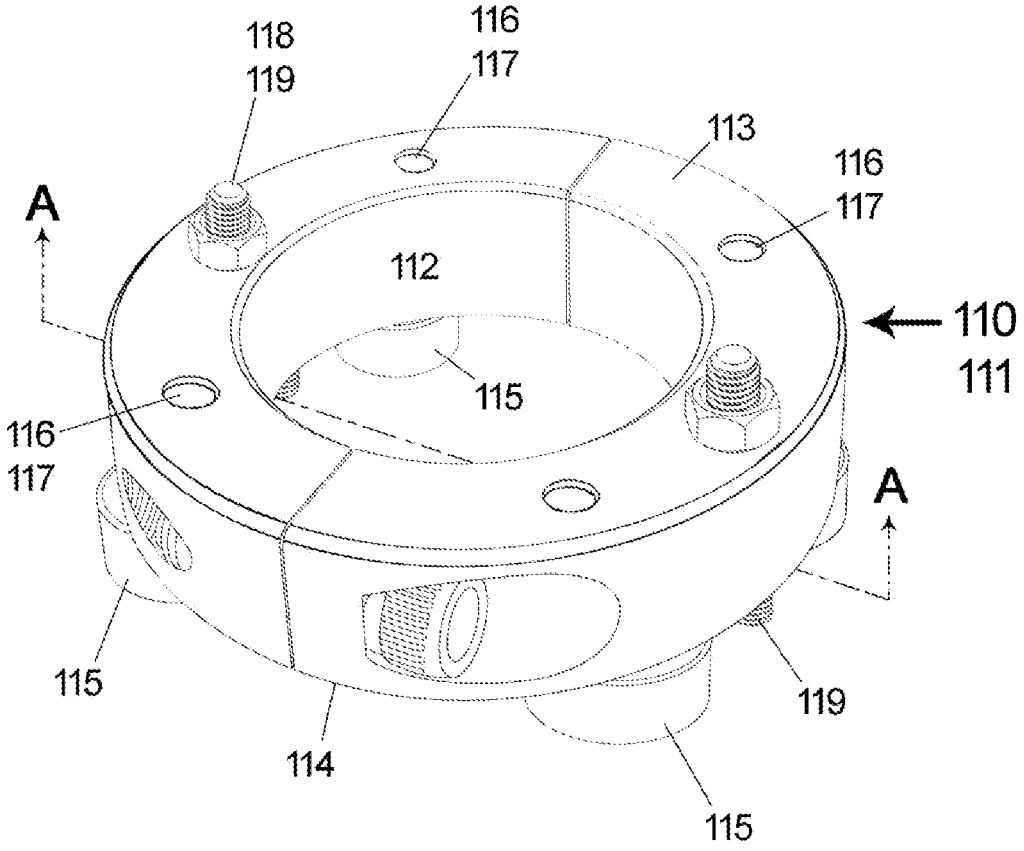
FIG. 5 is a perspective view of the magnetic component (pole clamp collar), shown in a closed position, identifying the vantage point A-A (resulting in View A-A), and outlining using the descriptive key the locations of various features and components of the pole clamp collar, including the plurality of magnets and the plurality of spacer screws; in accordance with an exemplary embodiment of the present invention.
Figure 6:
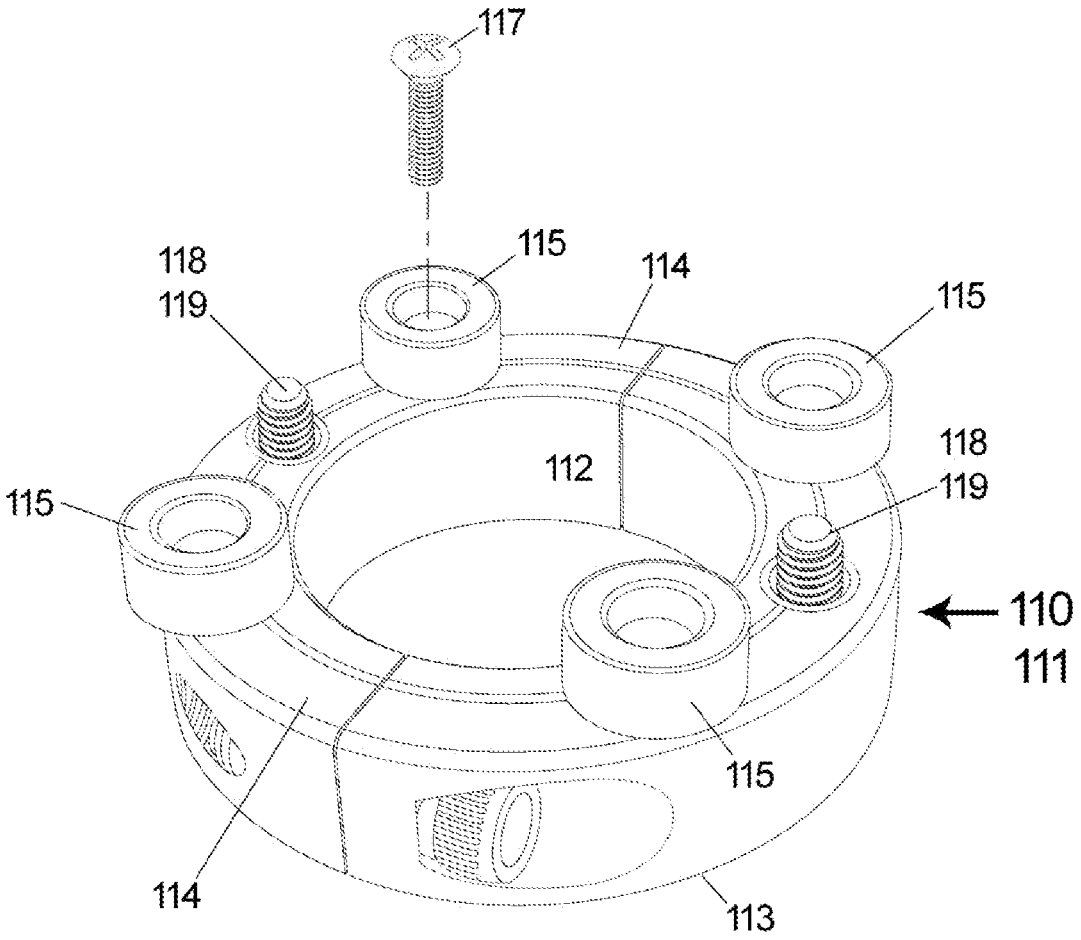
FIG. 6 is a perspective view of the pole clamp collar exposing the magnet surface, or View A-A, as identified in the FIG. 5, designed to show the plurality of magnets and the locations of the spacer screws; in accordance with an exemplary embodiment of the present invention.

As shown in FIGS. 4, 5 and 6, the magnetic component 110 further comprises of a pole clamp collar 111. The pole clamp collar 111 incorporates a pole clamp collar bore 112, a locking surface 113, a magnet surface 114, a plurality of magnet mounting holes 116, and a plurality of threaded holes 118.

Figure 7:
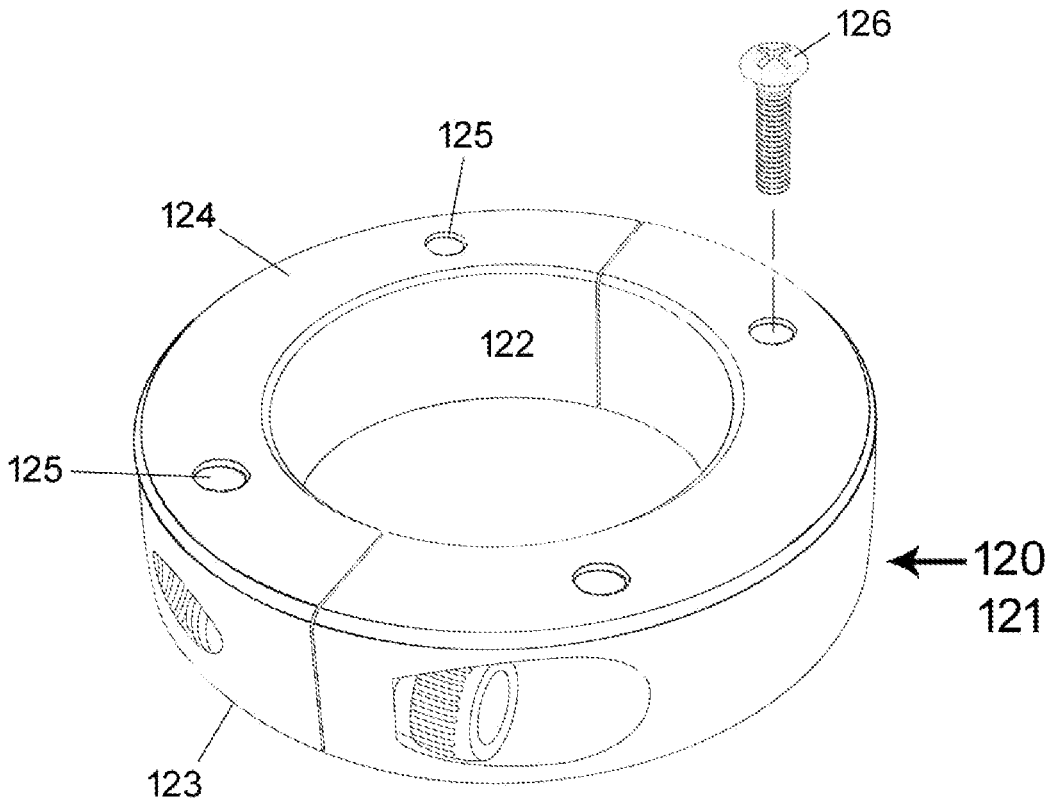
FIG. 7 is a perspective view of the metallic component, also known as the runner clamp collar, shown in a closed position, using the descriptive key to outline the locations of various features and components, including a plurality of mounting holes; in accordance with an exemplary embodiment of the present invention.

As shown in FIG. 7, the metallic component 120 further comprises of a runner clamp collar 121. The runner clamp collar 121 incorporates a runner clamp collar bore 122, a bottom surface 123, a top surface 124, and a plurality of mounting holes 125, protruding in from the top surface 124, and out from the bottom surface 123.

Figure 8:
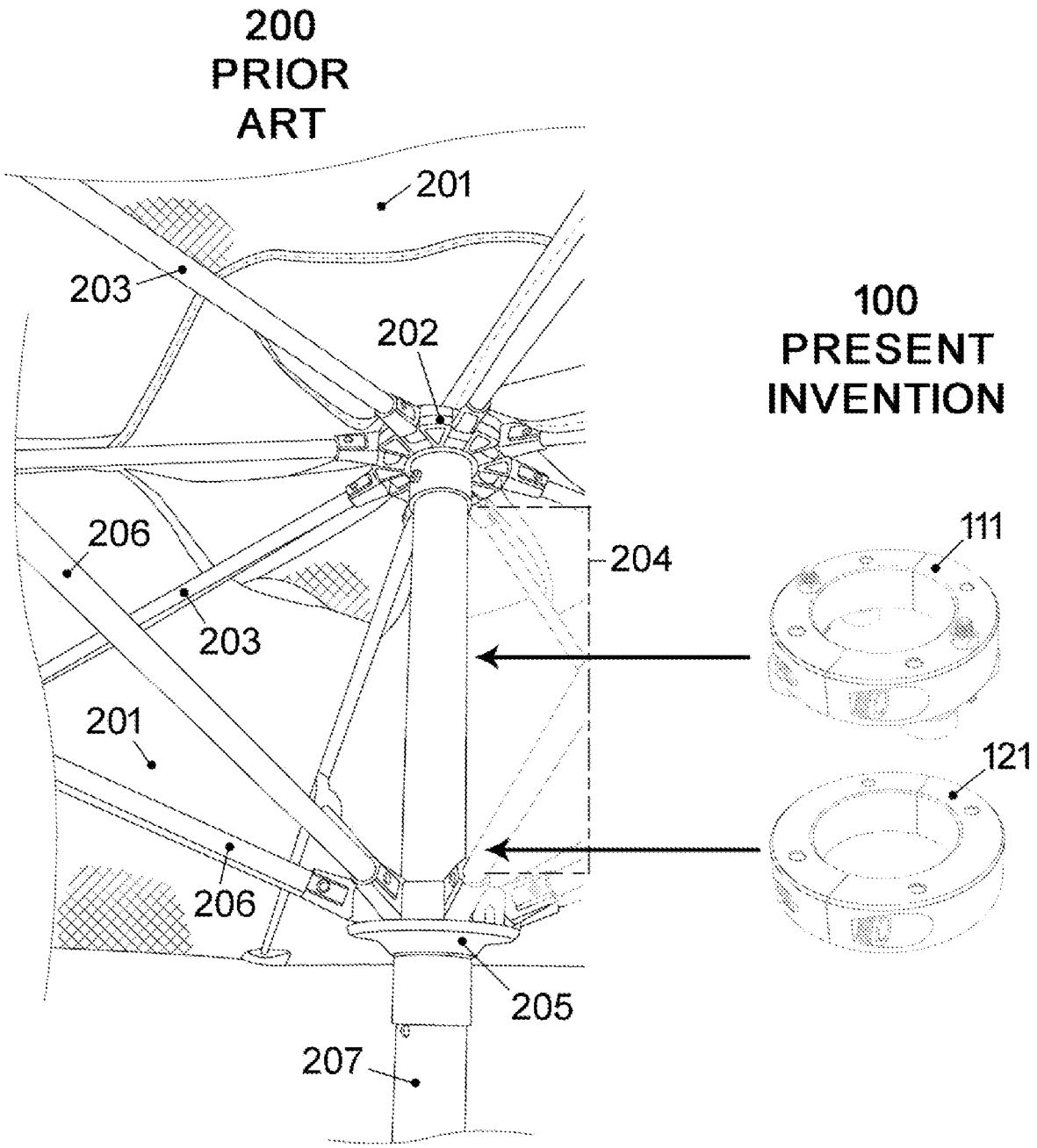
FIG. 8 is an illustration showing the internal structure of a patio umbrella (prior art), outlining using the descriptive key location of key components, namely the stationary hub, intermediate pole section, and the runner hub, as well as the mounting locations for the magnetic closing device (present invention), namely the pole clamp collar and the runner clamp collar; in accordance with an exemplary embodiment of the present invention.
Figure 9:
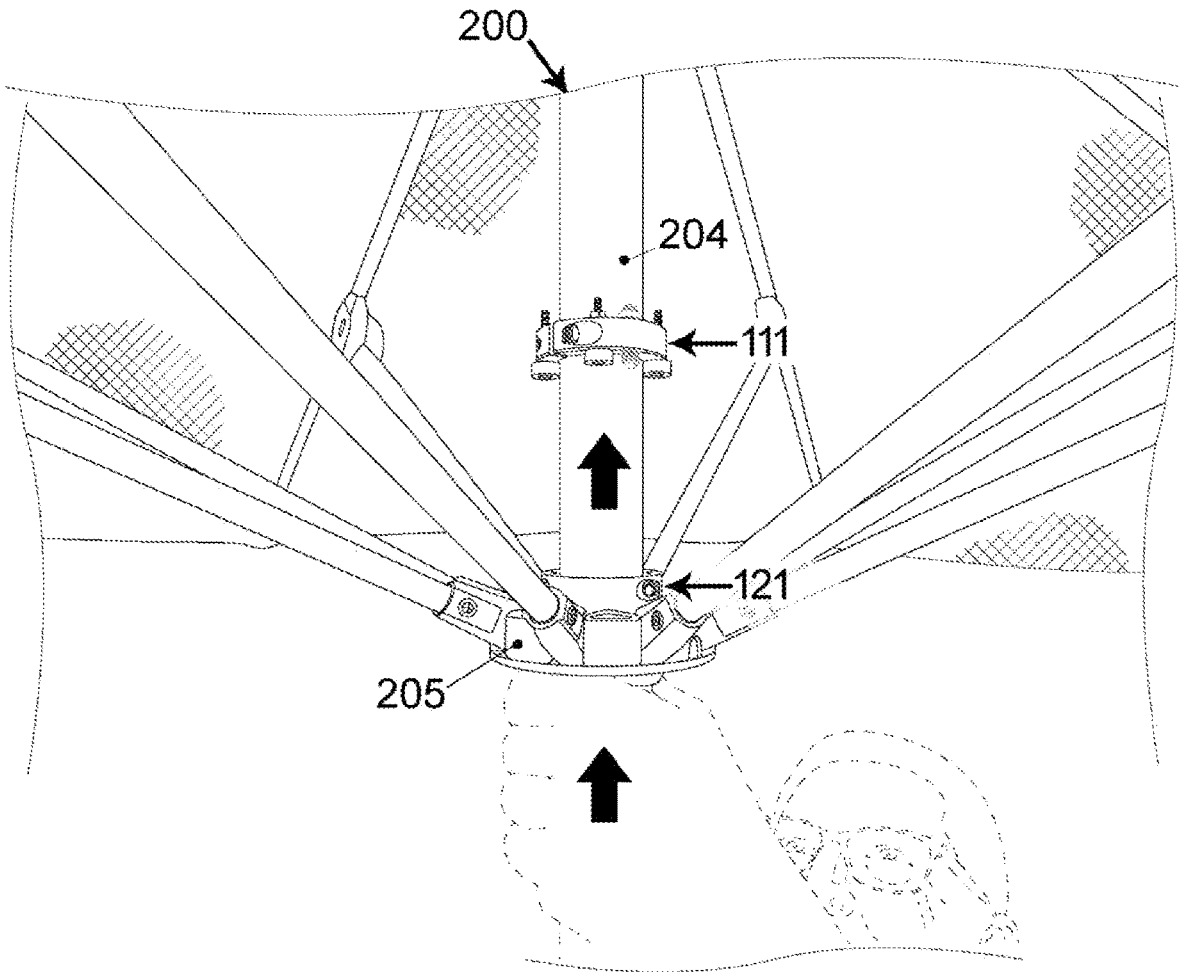
FIG. 9 is an illustration showing the process of opening a patio umbrella, focusing on the internal structure of the umbrella and attached thereto the magnetic closing device; more specifically the illustration is showing the runner hub, and attached thereto runner clamp collar, being pushed upwards to make a magnetic connection with the plurality of magnets disposed on the pole clamp collar; in accordance with an exemplary embodiment of the present invention.
Figure 10:
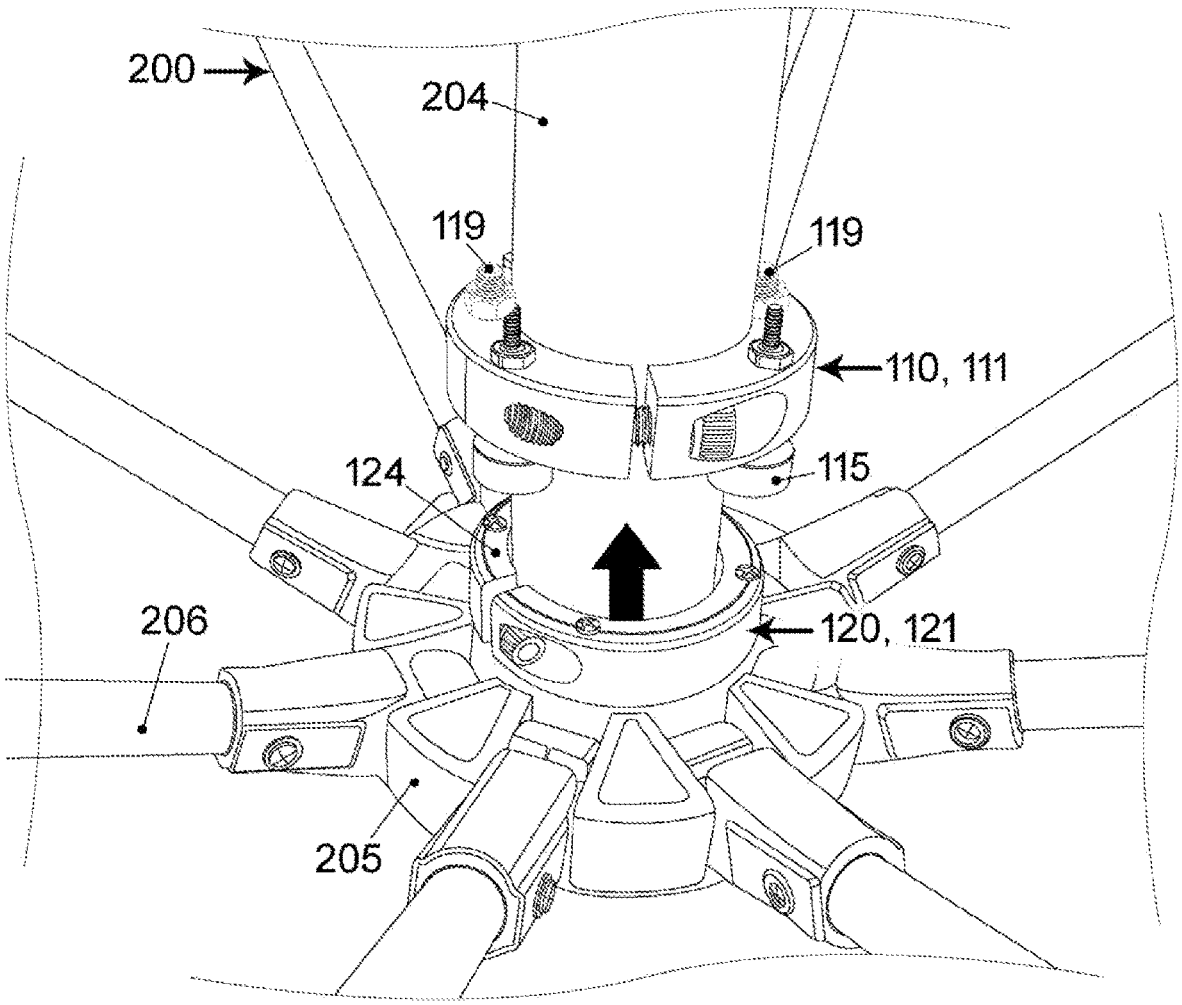
FIG. 10 is an illustration focusing on the internal structure of the umbrella and the positioning of the runner clamp collar, mounted to the runner hub of the umbrella, as well as the positioning of the pole clamp collar, mounted to the intermediate pole section; in accordance with an exemplary embodiment of the present invention.
Figure 11:
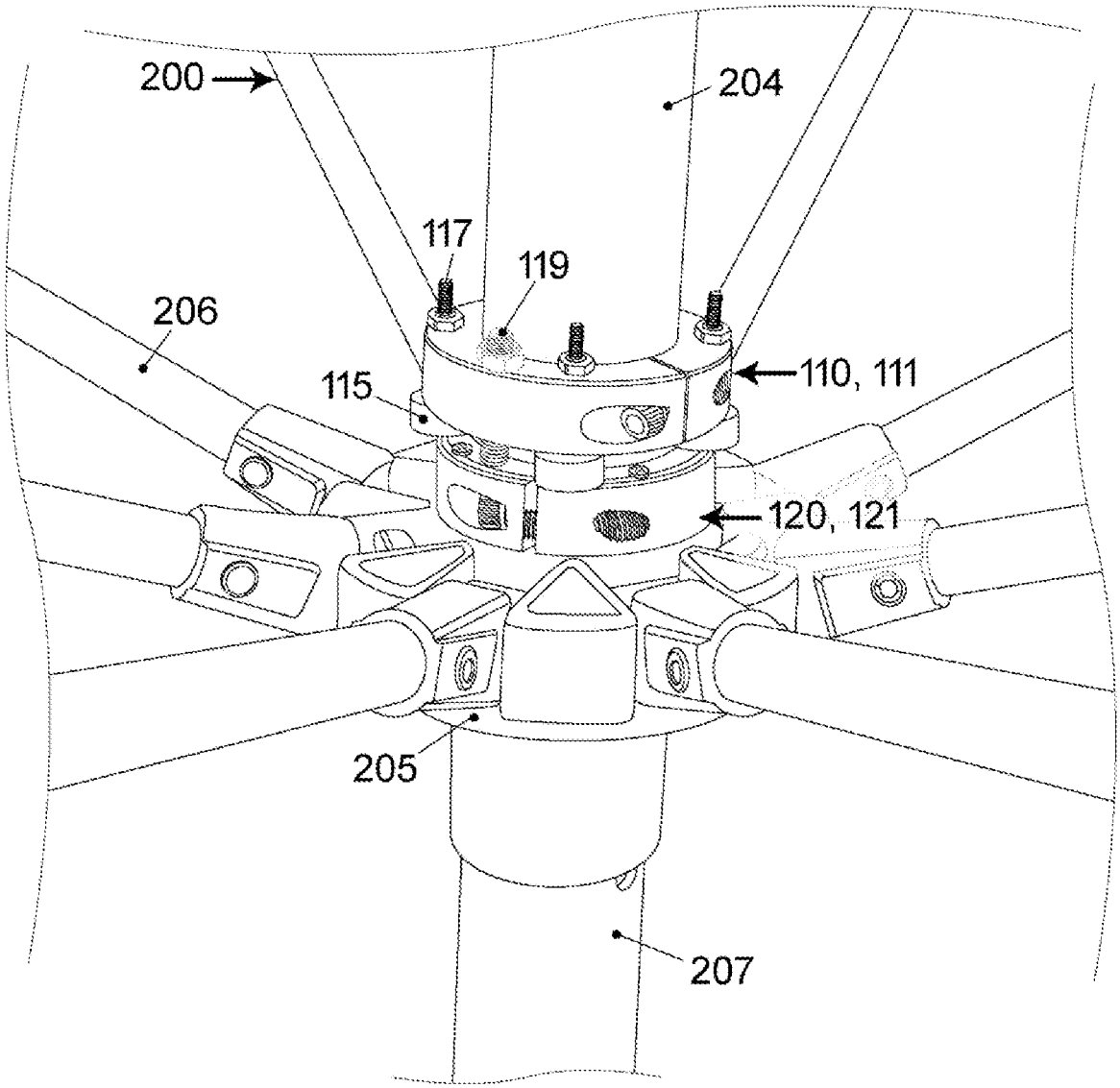
FIG. 11 is an illustration showing a close-up view of the magnetic connection made between the pole clamp collar (magnetic component) holding a plurality of magnets, and the runner clamp collar (metallic component), resulting in an open umbrella configuration dependent on the strength of the magnetic connection; in accordance with an exemplary embodiment of the present invention.
Figure 12:
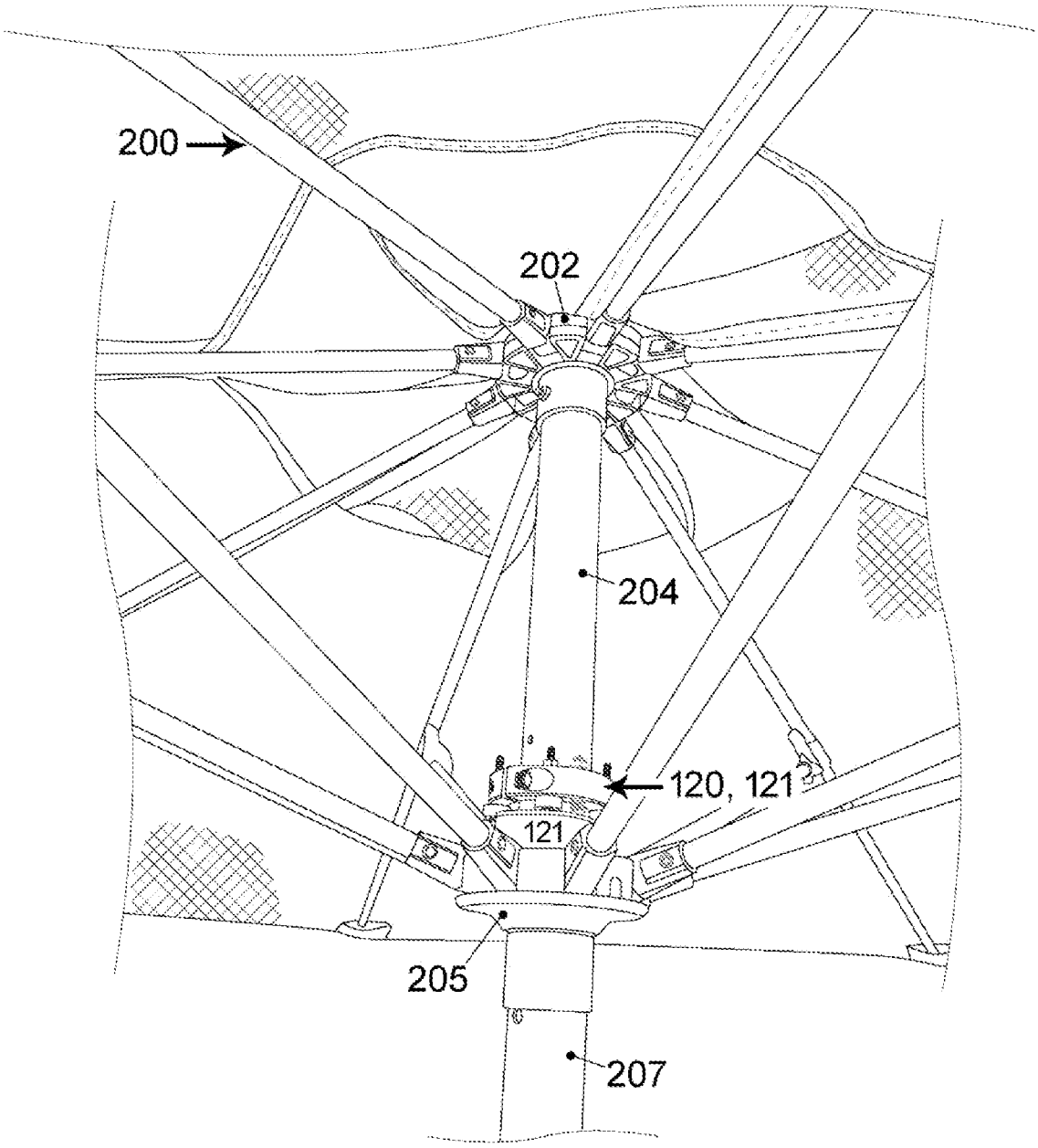
FIG. 12 is an illustration showing the internal structure of the umbrella and locations of its components when the magnetic connection between the pole clam collar and the runner clamp collar is made, resulting in an open umbrella configuration dependent on the strength of the magnetic connection; in accordance with an exemplary embodiment of the present invention.

As shown in FIGS. 8, 9 and 10, the runner clamp collar 121 is fixedly attached to the runner hub 205 of the umbrella using a plurality of mounting screws 126. The size of the clamp collar bore 122 is adjusted to enclose, but not to make contact with the intermediate pole section 204. This adjustment enables unobstructed movement of the runner hub 205 during the process of opening and closing of the umbrella 200.

To prepare the pole clamp collar 111 for attachment to the umbrella 200, the end-user must attach to it a plurality of magnets 115. As shown in FIG. 6, the magnets 115 are attached to the magnet surface 114 of the pole clamp collar 111, using a plurality magnet mounting holes 116 and a plurality magnet mounting screws 117. The magnets 115 used in this application may be selected from a group of commonly used magnets incorporating iron, nickel, and cobalt; or from a group of permanent magnets, commonly known as the rare-earth magnets, consisting of ceramic, alnico, samarium-cobalt, and neodymium.

However, it is foreseeable that in an alternative embodiment of the present invention, the magnetic component 110 is replaced with an electromagnet, powered by a battery and controlled by a potentiometer. Here, the strength of the magnetic attraction may be set to a fix value, predetermined to function effectively with a given model of the umbrella; or the strength of the magnetic attraction may be controllable via a software application, thereby simplifying the control of the magnetic attraction.

The pole clamp collar 111 also incorporates a plurality of spacer screws 119. More specifically, the number of spacer screws 119 disposed on the pole clamp collar 111 may vary between 1 and 6, depending on the size of the umbrella 200. The spacer screws 119 are used for controlling the strength of the magnetic field, by adjusting the distance between the magnets 115 and the metallic component 120. The spacer screws 119 are threaded into the threaded holes 118, and protrude in from the locking surface 113, and out from the magnet surface 114.

Once the magnets 115 are in place, the pole clamp collar 111 is attached to the intermediate pole section 204 of the umbrella 200. Here, the size of the pole clamp collar bore 122 may be adjusted to correspond with the size of the intermediate pole section 204, allowing the end-user to fixedly clamp the pole clamp collar 111 to the intermediate pole section 204. The exact location of the pole clamp collar 111 within the intermediate pole section 204 will be determined and adjusted by the end-user to accommodate different designs of commercially-available umbrellas.

As shown in FIGS. 9, 10, 11 and 12, to open the umbrella 200, the end-user will push the runner hub 205 toward the stationary hub 202 of the umbrella 200. The magnetic connection between the pole clamp collar 111 and the runner clamp collar 121 will be made exactly at a location where the canopy 201 becomes fully stretched by the ribs 203. The magnetic connection will effectively lock in place the stretchers 206, supporting the ribs 203, resulting in fully-open umbrella 200.

Figure 13:
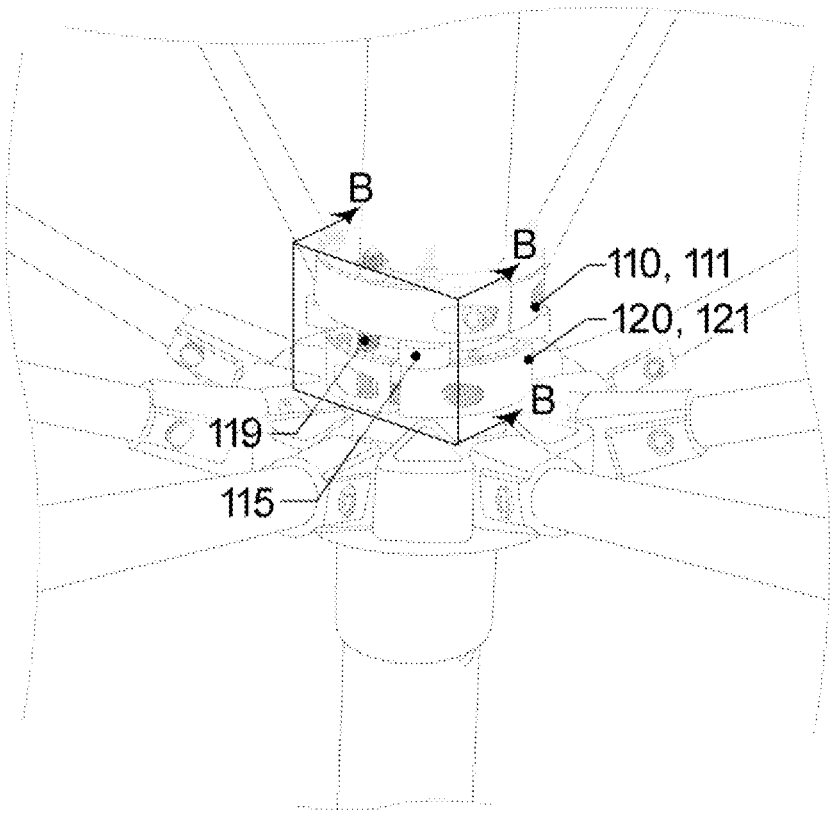
FIG. 13 is an illustration providing View B-B, designed to show the plurality of spacer screws pushing on the metallic component and creating and creating a gap between the magnetic component and the metallic component thereby reducing strength of the magnetic connection; in accordance with an exemplary embodiment of the present invention.
Figure 13:
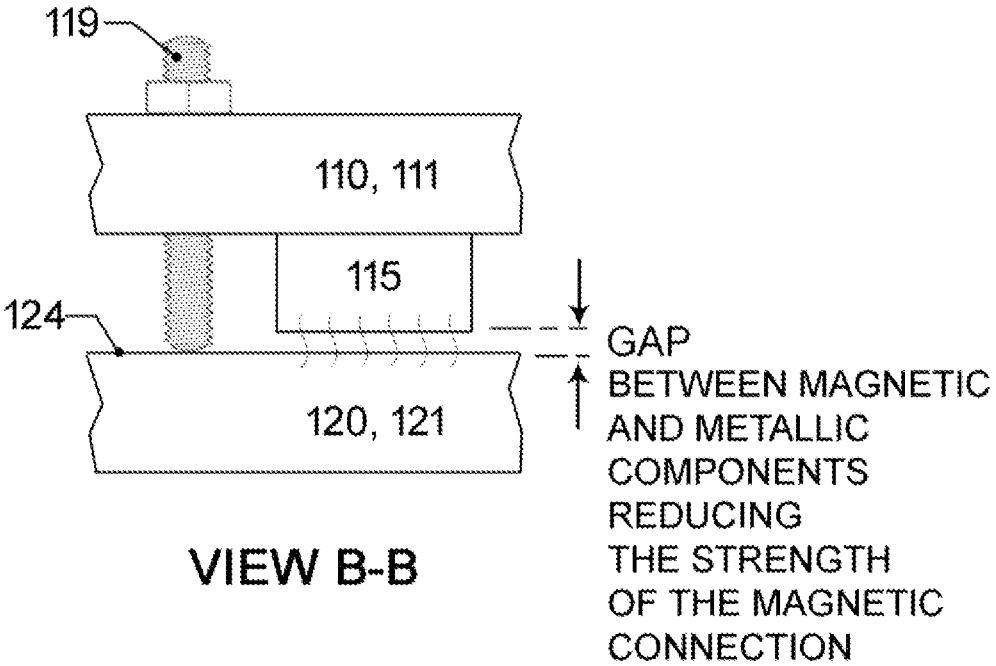

Once the umbrella 200 is fully opened, the end-user may test the strength of the magnetic connection (magnetic field) by pulling apart the pole clamp collar 111 away from the runner clamp collar 121. If the magnetic connection is too strong, the end-user may adjust the spacer screws 119, by extending them further away from the magnet surface 114, thereby creating a greater gap between the magnets 115 and the top surface 124 of the runner clamp collar 121, as shown in FIG. 13. This adjustment will determine what strength of wind pushing on the canopy 201 will break the magnetic connection. The magnetic closing device 100 will keep the umbrella 200 in an open position as long as the finely-adjusted magnetic connection between the pole clamp collar 111 away from the runner clamp collar 121 is maintained. The disruption of the magnetic connection will result in an immediate closure of the umbrella 200, thereby protecting it from damage or complete destruction.

I claim:

1. A universal retrofittable magnetic closing device for an outdoor umbrella, comprising:

(A) a magnetic component, producing a magnetic field, fixedly disposed on an intermediate pole section of the outdoor umbrella;

(B) a metallic component, made from ferromagnetic metals, fixedly disposed on a runner hub of the outdoor umbrella, configured to slidably move up and down the intermediate pole section;

(C) wherein the metallic component is configured, upon opening a canopy of the umbrella, to make contact with the magnetic component, thereby creating a magnetic connection between the metallic component and the magnetic component; and (D) wherein said magnetic connection is configured to keep the umbrella open until wind of predetermined strength urges on the canopy so that the magnetic connection is severed, resulting in closure of the umbrella.

2. The universal retrofittable magnetic closing device for an outdoor umbrella of claim 1, wherein: said magnetic component is a rare-earth magnet.

3. The universal retrofittable magnetic closing device for an outdoor umbrella of claim 1, wherein said magnetic component further comprising: a plurality of spacer screws.

4. The universal retrofittable magnetic closing device for an outdoor umbrella of claim 3, wherein said plurality of spacer screws are configured to adjustably protrude from the magnetic component urging on the metallic component so that a gap is created between the magnetic component and the metallic component thereby reducing strength of the magnetic connection.

5. The universal retrofittable magnetic closing device for an outdoor umbrella of claim 1, wherein: said magnetic component is an electromagnet, powered by a battery and controlled by a potentiometer.

6. The universal retrofittable magnetic closing device for an outdoor umbrella of claim 5, wherein: said potentiometer is controlled remotely by a software application.

7. A universal retrofittable magnetic closing device for an outdoor umbrella, comprising:

(A) a magnetic component; said magnetic component is a pole clamp collar, fixedly disposed on an intermediate pole section of the outdoor umbrella; having:
  (a) a pole clamp collar bore,
  (b) a locking surface,
  (c) a magnet surface,
  (d) a plurality of magnets,
  (e) a plurality of magnet mounting holes, disposed on the magnet surface, for fixedly mounting thereto the plurality of magnets,
  (f) a plurality of threaded holes, protruding in from the locking surface and out from the magnet surface,
  (g) a plurality of spacer screws, threaded into the threaded holes;

(B) a metallic component; said metallic component is a runner clamp collar, fixedly disposed on a runner hub of the outdoor umbrella, having:
  (a) a runner clamp collar bore,
  (b) a bottom surface,
  (c) a top surface,
  (d) a plurality of mounting holes, protruding in from the top surface, and out from the bottom surface, used for fixedly mounting the runner clamp collar to a runner hub of the umbrella, (C) wherein said runner clamp collar is configured to slidably move up and down the intermediate pole section;

(D) wherein the plurality of magnets are configured upon opening a canopy of the umbrella to make contact with the pole clamp collar, thereby creating a magnetic connection between the pole clamp collar and the runner clamp collar;

(E) wherein said plurality of spacer screws are configured to adjustably protrude from the magnet surface urging on the runner clamp collar so that a gap is created between the plurality of magnets and the runner clamp collar thereby reducing strength of the magnetic connection; and (F) wherein said magnetic connection is configured to keep the umbrella open until wind of predetermined strength urges on the canopy so that the magnetic connection is severed, resulting in closure of the umbrella.

8. The universal retrofittable magnetic closing device for an outdoor umbrella of claim 7, wherein: the plurality of magnets are fixedly mounting to the magnet surface using a plurality of magnet mounting screws.

9. The universal retrofittable magnetic closing device for an outdoor umbrella of claim 7, wherein: each of the plurality of magnets is a permanent magnet.

10. The universal retrofittable magnetic closing device for an outdoor umbrella of claim 9, wherein: said permanent magnet is a rare-earth magnet.

* * * * *